US009254957B2

(12) United States Patent
Cheney

(10) Patent No.: US 9,254,957 B2
(45) Date of Patent: Feb. 9, 2016

(54) LAWN CARE LEAF AND DEBRIS COLLECTION SYSTEM

(71) Applicant: Darrell Cheney, Acworth, GA (US)

(72) Inventor: Darrell Cheney, Acworth, GA (US)

( * ) Notice: Subject to any disclaimer, the term of this patent is extended or adjusted under 35 U.S.C. 154(b) by 0 days.

(21) Appl. No.: 14/298,901

(22) Filed: Jun. 7, 2014

(65) Prior Publication Data

US 2014/0286594 A1 Sep. 25, 2014

Related U.S. Application Data

(63) Continuation-in-part of application No. 13/481,844, filed on May 27, 2012, now Pat. No. 8,882,350.

(51) Int. Cl.

| | |
|---|---|
| ***B65D 33/01*** | (2006.01) |
| ***B65F 1/14*** | (2006.01) |
| ***B65F 1/10*** | (2006.01) |
| *B65F 1/00* | (2006.01) |

(52) U.S. Cl.

CPC ..... *B65F 1/1415* (2013.01); *B65F 1/10* (2013.01); *B65F 1/002* (2013.01); *B65F 1/0006* (2013.01); *B65F 2210/181* (2013.01); *B65F 2240/138* (2013.01)

(58) Field of Classification Search

CPC ..... B65D 33/01; B65D 2205/00
USPC ..... 383/100, 102, 103, 72; 56/199, 202
See application file for complete search history.

(56) References Cited

U.S. PATENT DOCUMENTS

| | | | | |
|---|---|---|---|---|
| 2,225,389 | A * | 12/1940 | Osterdahl | 55/376 |
| 3,040,966 | A * | 6/1962 | Crane | 383/103 |
| 3,245,606 | A * | 4/1966 | Crane | 383/103 |
| 3,495,764 | A * | 2/1970 | Crane | 383/103 |
| 4,503,561 | A * | 3/1985 | Bruno | 383/102 |
| 4,709,400 | A * | 11/1987 | Bruno | 383/77 |
| 4,957,791 | A * | 9/1990 | Richter | 428/35.5 |
| 5,003,758 | A * | 4/1991 | Bernstein | 56/202 |
| 6,113,269 | A * | 9/2000 | DeMatteis et al. | 383/103 |
| 6,135,637 | A * | 10/2000 | Kim | B65D 33/01 383/103 |
| 6,988,293 | B2 | 1/2006 | Ritter | |
| 7,490,787 | B1 | 2/2009 | Salazar | |
| 8,882,350 | B2 * | 11/2014 | Cheney | 383/75 |
| 2004/0197031 | A1 * | 10/2004 | Torick | 383/102 |
| 2005/0025397 | A1 | 2/2005 | Zhao | |
| 2007/0157424 | A1 * | 7/2007 | Mottahedeh | 15/405 |

FOREIGN PATENT DOCUMENTS

| | | | | |
|---|---|---|---|---|
| FR | 2582625 | A1 * | 12/1986 | B65D 33/01 |
| JP | 04041301 | A * | 2/1992 | B65F 1/00 |
| JP | 05254604 | A * | 10/1993 | |

* cited by examiner

*Primary Examiner* — Jes F Pascua
(74) *Attorney, Agent, or Firm* — The Keys Law Firm, PLLC

(57) ABSTRACT

An air gill bag of a debris collection and disposal system (or lawn care leaf and debris collection system) for receiving a leaves, yard debris and other types of suitable debris for containment for subsequent disposal. The air gill bag comprises an elongated bag body which includes an open top, a closed bottom, a plurality of air gill cut strips, and a plurality of strength strips. In the preferred embodiment, the air gill cut strips and the strength strips form columns of perforated and non-perforated surface material. Such a configuration allows the propelled air directed into the bag to be ventilated through the bag and debris directed into the bag to be trapped, with the bag still retaining much of its durability and tear resistance despite presence of extensive perforations. The air gill bag is typically attached to the vacuum bag outlet of a machine blower using a dual attachment strap.

5 Claims, 4 Drawing Sheets

LAWN CARE LEAF AND DEBRIS COLLECTION SYSTEM

CROSS REFERENCE TO RELATED APPLICATIONS

This application is a continuation in part of, incorporates by reference, and claims the benefit of co-pending U.S. patent application Ser. No. 13/481,844 filed May 27, 2012.

BACKGROUND OF THE INVENTION

1. Field of the Invention

This invention relates generally to a debris collection and disposal system and, more particularly, to a disposable bag employing an air gill cut strip and strength strip system that allows propelled air to pass through while debris carried by the passing air is collected.

2. Description of the Prior Art

Conventional methods of removing fallen leaves and other yard debris from an area typically include manually picking up such debris and placing it in a container for disposal, using a machine to direct debris to a desired location using propelled air, or using a machine which employs a vacuum to suck up debris into a reusable bag which must be periodically emptied. As such, a problem which still exists is that existing debris collection systems typically require extensive and recurring manual labor, whether it be repeatedly picking up piles of debris or repeatedly emptying a reusable bag into a disposal container. Thus, there remains a need for a debris collection and disposal system implemented through an air gill bag that allows debris to be sucked up by a machine employing a vacuum directly into a disposable container. It would be helpful if such an air gill bag based debris collection and disposal system enabled the sufficient ventilation during the collection of debris to avoid the buildup of excessive pressure. It would be additionally desirable for such an air gill bag based debris collection and disposal system to be structured to retain sufficient strength to be moved even when full.

The Applicant's invention described herein provides for a debris collection and disposal system which incorporates an air gill bag defined as a semi-permeable container suitable to collect leaves and other yard debris. The primary component in Applicant's debris collection and disposal system is a disposable container employing air gill technology, embodied as air gill cut strips in grid arrangement and interspersed between a plurality of strength strips. When in operation, the air gill bag enables the simultaneous collection of debris in and the passage of air through a disposable container. As a result, many of the limitations imposed by prior art structures are removed.

SUMMARY OF THE INVENTION

An air gill bag of a debris collection and disposal system (or lawn care leaf and debris collection system) for receiving leaves, yard debris and other types of suitable debris for containment for subsequent disposal. The air gill bag comprises an elongated bag body which includes an open top, a closed bottom, a plurality of air gill cut strips, and a plurality of strength strips. In the preferred embodiment, the air gill cut strips and the strength strips form alternating columns of perforated and non-perforated surface material. Such a configuration allows the propelled air directed into the bag to be ventilated through the bag and debris directed into the bag to be trapped, with the bag still retaining much of its durability and tear resistance despite presence of extensive perforations.

The air gill bag is typically attached to the vacuum bag outlet of a machine blower using a dual attachment strap.

It is an object of this invention to provide a debris collection and disposal system implemented through an air gill bag that allows debris to be sucked up by a machine employing a vacuum directly into a disposable container.

It is another object of this invention to provide an air gill bag based debris collection and disposal system which additionally enables sufficient ventilation during the collection of debris to avoid the buildup of excessive pressure.

It is yet another object of this invention to provide an air gill bag based debris collection and disposal system which is structured to retain sufficient strength to be moved even when full.

These and other objects will be apparent to one of skill in the art.

DETAILED DESCRIPTION OF THE INVENTION

Figure 1A:
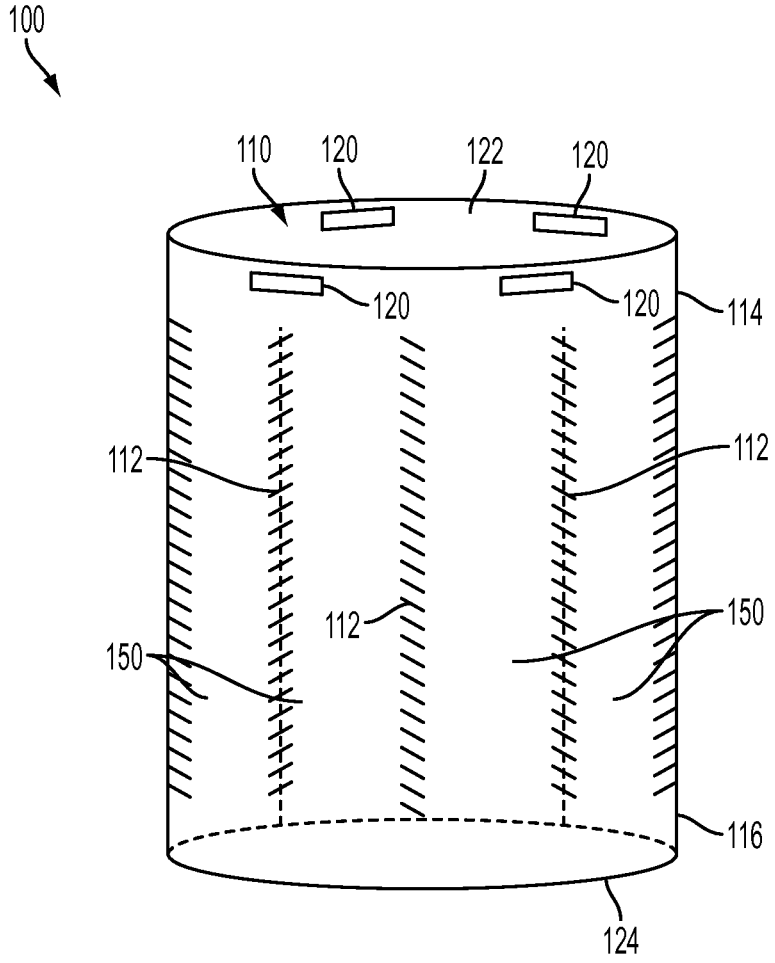
FIG. 1A is a side perspective view of an air gill bag of a debris collection and disposal system built in accordance with a first embodiment of the present invention.

Referring now to the drawings and in particular FIG. 1A, an air gill bag 110 is defined by a plurality of columns of air gill cut strips 112, a plurality of tie string ports 120, an open top 122, an enclosed bottom 124, and a plurality of columns of strength strips 150. In the first embodiment, the air gill bag is constructed of plastic and is typically positioned in a horizontal position on the ground or attached to the vacuum bag outlet of a machine blower.

Each air gill cut strip 112 is defined by a series of discrete gill cuts arranged in vertical columns. The air gill cut strips 112 form an alternatively perforated surface which encircles the circumference of the air gill bag 110 and provides ventilation sufficient to regulate airflow while air carrying debris is being forced into the air gill bag 110 in accordance with the operation of the debris collection and disposal system 100.

Towards the open top 122 of the air gill bag 110 is an approximate 3 inch top exterior smooth area 114. The top exterior smooth area 114 is defined by its non-perforated surface around the entire circumference of the air gill bag 110 as it lacks any gill cuts. The exterior smooth area does include the tie string ports 120 around the neck of the bag, whose function is described in more detail in FIG. 1B.

Towards the closed bottom 124 of the air gill bag 110 is an approximate 5 inch bottom exterior smooth area 116. As with the top exterior smooth area 114, the bottom exterior smooth area 114 is defined by its non-perforated surface around the entire circumference of the air gill bag 110. It is contemplated that gill cuts can be added to the bottom exterior smooth area 114 to increase the ventilation capability for use with a relatively large blower as long as the gill cuts do not extend all the way to the closed bottom 124.

The strength strips 150 each define a column of non-perforated surface interspersed between the columns of air gill cut strips 112. Being arranged in contiguous columns spanning from the top exterior smooth area 114 to the bottom exterior smooth area 114, this smooth, non-perforated surface maintains the strength of the air gill bag 110, enabling it to be transported, lifted, and tossed while containing debris so as to facilitate the disposal of used (and full) air gill bags 110. and support to the air gill bag 110.

When placed horizontally onto a ground surface or other suitable surface, the air gill bag 110 enables debris to be raked, shoveled therein. In such a configuration, debris can also be blown in with the air gill cut strips 112 ventilating the incoming air to prevent the buildup of excess pressure. In addition, if the air gill bag 110 is attached to the bag outlet of a vacuum (in place of the reusable bag), debris can be sucked therein, with the air gill cut strips 112 ventilating the incoming air to prevent the buildup of excess pressure.

Figure 1B:
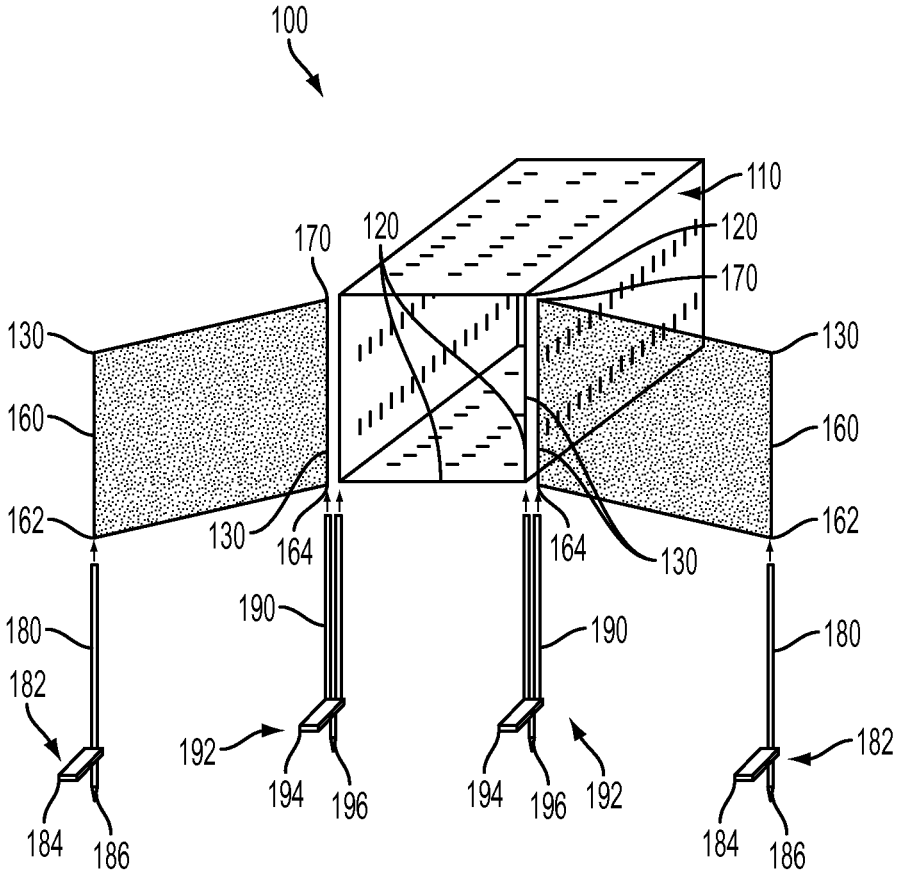
FIG. 1B is a front perspective view of an air gill bag and directional curtains of a debris collection and disposal system built in accordance with an embodiment of the present invention.
Figure 2C:
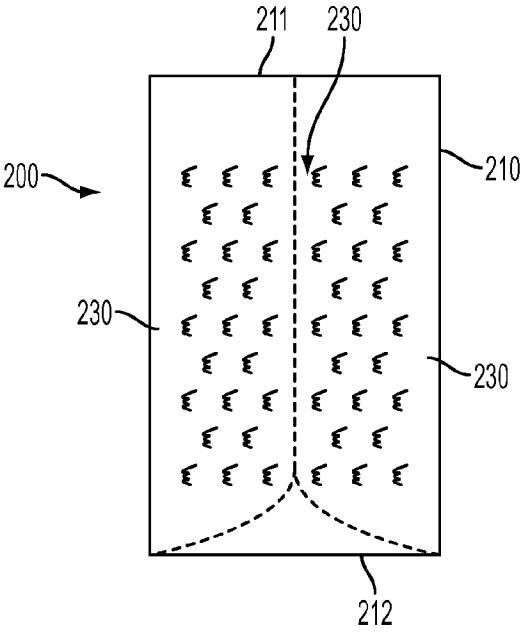
FIG. 2C is a side elevational view of an air gill bag of a debris collection and disposal system built in accordance with a second embodiment of the present invention.
Figure 2B:
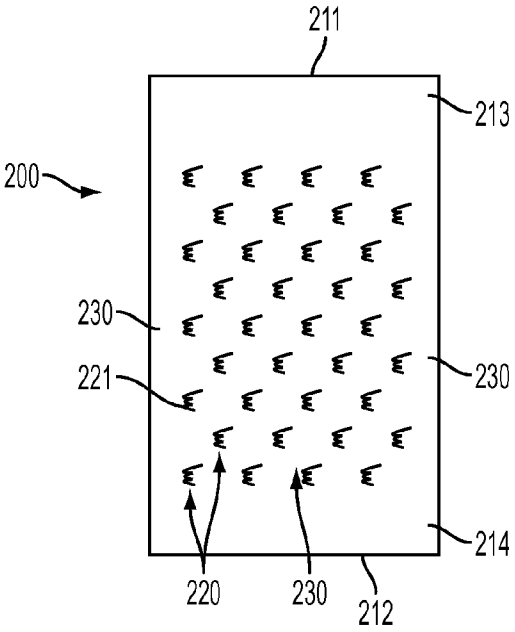
FIG. 2B is a back elevational view of an air gill bag of a debris collection and disposal system built in accordance with a second embodiment of the present invention.
Figure 2A:
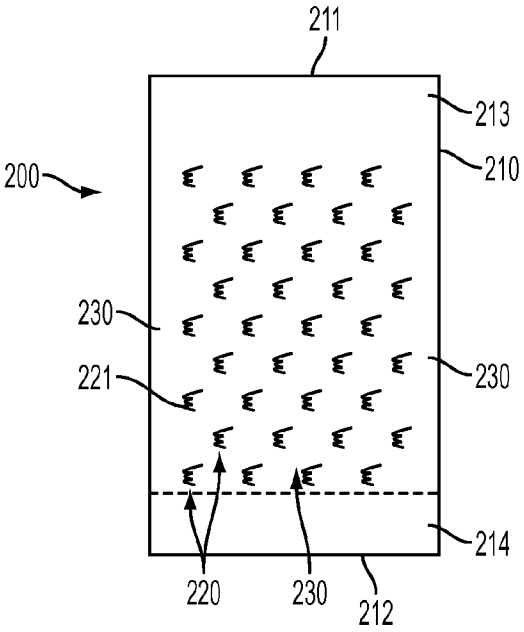
FIG. 2A is a front elevational view of an air gill bag of a debris collection and disposal system built in accordance with a second embodiment of the present invention.
Figure 3:
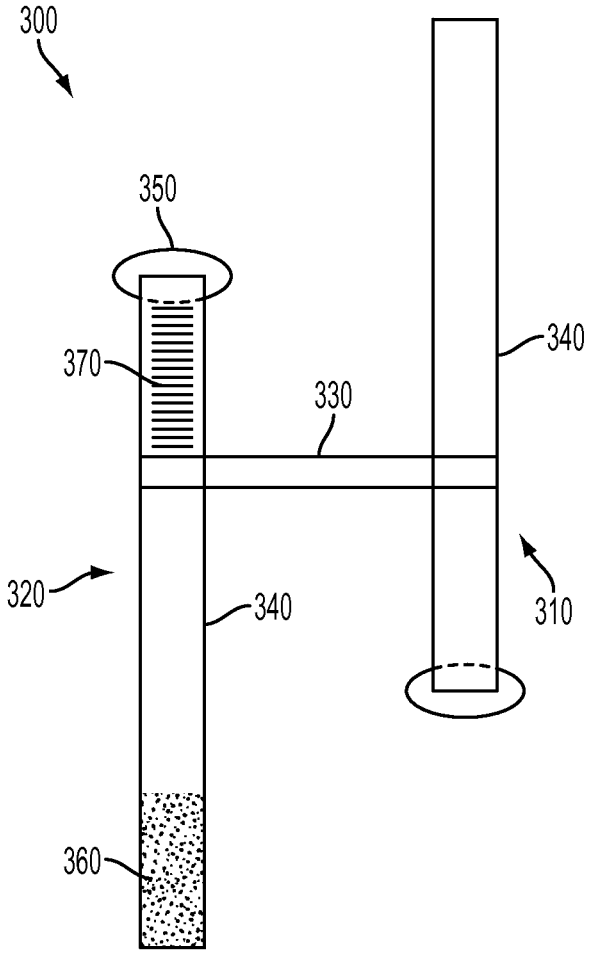
FIG. 3 is a top plan view of an attachment strap of an air gill bag of a debris collection and disposal system built in accordance with the present invention

Referring now to FIG. 1B, a pair of directional curtains 160 can be used in combination with an air gill bag 110 to enhance the stability and efficacy of debris collection and disposal system 100. The air gill bag 110, as defined in FIG. 1A is attached to a pair of air curtains 160 through the tie string ports 120, a pair of single rod vertical supports 180, and a pair of double rod vertical supports 190.

The pair of air curtains 160 are each removably attached at one end to one rod of the double rod vertical supports 190 and the other end of the single rod vertical support 180 of the air gill bag 110. The other, unused rod of each double rod vertical supports 190 is removably attached through the tie string ports 120 (FIG. 1A) forming the removable attachment of the air gill bag 110 and the pair of air curtains 160 via the double rod vertical supports 190. The pair of double rod supports 190 is attached to the proximal end bottom 164 of the pair of air curtains 160. The pair of double rod supports 190 is slid in a sleeve 130 and is removably and adjustably secured within the sleeve 130.

The single rod vertical supports 180 are slid into a sewn sleeve at the distal end bottom 162 of the pair of air curtains 160. The single rod vertical supports 180 have a distal end 182 where a horizontal plate 184 and a spike 186 are disposed. The spike 186 is typically approximately 6 inches long but can be any suitable length. The horizontal plate 184 limits the distance the distal end 182 of the single rod vertical supports 180 can go into the ground surface.

The double rod vertical supports 190 have a distal end 192 where a horizontal plate 194 and a spike 196 are disposed. The spike 186 is typically approximately 6 inches long but can be any suitable length. The horizontal plate 194 limits the distance the distal end 192 of the double rod vertical supports 190 can go into the ground surface. Both the single rod vertical supports 180 and the double rod vertical supports 190 secure the pair of air curtains 160 and the air gill bag 110 in a secured and set position to form an opening for the debris to be directed into the air gill bag 110.

Referring now to FIGS. 2A, 2B, 2C, and 3, an air gill bag 200 is defined by an elongated bag body 210 which includes an open top 211, a closed bottom 212, a plurality of columns of air gill cut strips 220, and a plurality of columns of strength strips 230. In the preferred embodiment, the bag body is constructed in the preferred embodiment two-ply wet-strength paper, with its open top 211 typically attached to the vacuum bag outlet of a machine blower using a dual attachment strap 300.

Each air gill cut strip 220 is defined by a series of discrete gill cuts 221 arranged in a vertical column which extends around the entire exterior of the bag body 210. In the preferred embodiment, each discrete air gill cut 221 is shaped in a zigzag pattern and is one to one and one half inches long. Due to the nature of the paper material which defines the bag body 210, particularly its inability to stretch, the zigzag cuts 220 enable the air gill bag 200 to allow air forced therein to pass through while containing the debris forced therein with the air.

The strength strips 230, each defined by a column of non-perforated surface that is interspersed between air gill cut strips 220, are disposed at various points around the entire exterior of the bag body 210, providing an unbroken surface area which enables the bag body 210 to retain much of its durability and tear resistance despite presence of a plurality of air gill cuts 221 in the bag body 210. In one embodiment, the strength strips 230 are two inches wide. Also maintaining the strength of the bag body 210 is the offset alignment of successive air gill cut strips 220. While this offset alignment results in every second air gill cut strip 220 being aligned horizontally, preventing successive air gill cut strips 220 from being aligned (and forming a row) and reducing the size of potential weak points in the bag body 210.

It is contemplated that in another embodiment, the offset alignment results in every third, fourth or fifth air gill cut strip 220 are aligned vertically.

As in the first embodiment, towards the open top 211 of the bag body 210 is a top exterior smooth area 213 and towards the closed bottom 212 of the bag body 210 is a bottom exterior smooth area 214. In one embodiment, the top exterior smooth area 213 and the bottom exterior smooth area 214 are six inches from the top and bottom of the air gill bag, respectively. As in the first embodiment, in the preferred embodiment these smooth areas again reduce potential weakness in the surface of the bag body 210, maintaining the most strength and durability. In addition, to enable the open top 211 to attach to the vacuum bag outlet of a machine blower, the top exterior smooth area 213 provides a solid surface that can be folded in a crimp or a four fold manner to snugly wrap around the vacuum bag outlet for fastening.

It is contemplated that in the preferred, heavy paper version of the air gill bag 200, the air gill bag 200 will be foldable into a small, substantially flat rectangle so that it can be stored. In effort to retain as much strength in the air gill bag 200, strength strips 230 and the bottom exterior smooth area 214 are mostly located over areas of the bag having creases (shown in FIGS. 2A, 2B, and 2C as dotted lines) to enable the folding of the air gill bag 200 as well as the corners of the air gill bag 200 It is understood that if perforations were included in such areas, the strength of the bag would be affected moreso than perforations on no folded or creased areas.

It is further contemplated that in order to facilitate mass production of the air gill bag 200, it is desirable to avoid placing perforations in locations under which creased or folded areas of the air gill bag 200, when folded, would be present. In this regard, a center strength strip 230 is included to avoid compromising the folded in edge of the side of the air gill bag 200.

The attachment strap 300 is defined by a first attachment member 310 permanently attached upside down and in the opposite direction to a second attachment member 320 that is identical to the first attachment member 310 through a connective member 330. Each attachment member includes an elongated body 340, a fastening loop 350 for tightening the attachment strap 300, a hook fastening surface 360 of a fabric hook and loop fastener and a loop fastening surface 370 of a fabric hook and loop fastener. It is understood that as the first attachment member 310 is upside down relative to the second attachment member 320, its hook fastening surface and a loop fastening surface, while located in the exact orientation as that of the second attachment member 320, are on the side of the first attachment member 310 not visible in FIG. 3.

In operation, the first attachment member 310 can wrap around the top exterior smooth area 213, tighten it around the circumference of the vacuum bag outlet of a conventional leaf blower and vacuum (when configured as a vacuum) (not shown), and fasten it in place once tightened. Then, the second attachment member 320 can be wrapped in the opposite direction (relative to the bag body 210) around the body of conventional leaf blower and vacuum and then tightened and fastened. Through this dual fastening action, the open top 211 is compressed around and held over the vacuum outlet of a conventional leaf blower and vacuum through the exertion of circumferential stress (in a radial direction) being applied thereto from straps wrapped in opposing directions.

In one embodiment, the first attachment member 310 and the second attachment member 320 are constructed of different colored material to assist in distinguishing the two.

The lawn care leaf and debris collection system is designed to be utilized with or without an air blower and enhances one's ability to gathering leaves and other debris. The lawn care leaf and debris collection system includes a disposable bag, manufactured with a plurality of slit and perforated cuts defined as gills and may incorporate a pair of side fenced air curtains that are removably connected to the primary centered air gill bag by two single and two double rod anchor stakes that slide through sewn sleeves at each curtain end and tie string ports on each side of the air gill bag. When used with the air curtains, the lawn care leaf and debris collection system functions as a stationary air controlling system, grounded by a plurality of 6-inch spiked plates at the base of each anchor stake, allowing for stability and consistency as an air blower forces leaves and debris into the system. The lawn care leaf and debris collection system permits incoming air to pass through the gills leaving only the debris remains securely inside the air gill bag, thus alleviating the necessity of raking or bagging leaves. The lawn care leaf and debris collection system is a product which utilizes strength strips arranged alternatively with a plurality of strips gill cuts to enable the air gill bag to maintain structural integrity in the face of substantial debris volume, air pressure, or other force. The air gill bags are adapted to be used with any conventional leaf blower and vacuum having a vacuum outlet port to which it can be attached.

It is contemplated that the air gill bag can be manufactured from different materials, including paper, conventional plastic, and biodegradable plastic.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A debris collection and disposal system, comprising:

an air gill bag defined by an elongated bag body having an open top, a closed bottom and at least two identical, opposing sides, wherein said bag body includes a top exterior smooth area adjacent to said open top, thereby adapting the bag body to be folded around a vacuum bag outlet of a conventional leaf blower and vacuum, and a bottom exterior smooth area adjacent to said closed bottom;

a plurality of air gill cut strips integral with said bag body, each defined by a series of discrete gill cuts arranged in a vertical column which extends from the top exterior smooth area to the bottom exterior smooth area, wherein the plurality of air gill cut strips are positioned on the bag body across at least each of the identical, opposing sides in between the top exterior smooth area and the bottom exterior smooth area;

a plurality of strength strips integral with said bag body, each defined by a column of non-perforated material that is interspersed between columns of air gill cut strips;

an attachment strap defined by a first elongated attachment member, a second elongated attachment member, and a connective member, wherein said first elongated attachment member and said second elongated attachment member are identical and are each permanently attached to the connective member in an upside down orientation and facing an opposite direction relative to one another such that the first elongated attachment member and second elongated attachment member are each independently operative to be wrapped around the top exterior smooth area when the top exterior smooth is folded around a vacuum bag outlet of a conventional leaf blower and vacuum so as to secure the air gill bag to the vacuum bag outlet through a dual fastening action.

2. The debris collection and disposal system of claim 1, wherein said air gill bag is constructed out of paper.

3. The debris collection and disposal system of claim 2, wherein each discrete gill cut is shaped in a zigzag pattern.

4. The debris collection and disposal system of claim 1, wherein successive rows of air gill cut strips are offset, resulting in every second air gill cut strip being aligned horizontally and successive air gill cut strips not being aligned horizontally.

5. The debris collection and disposal system of claim 1, wherein said air gill bag is constructed out of plastic.

* * * * *